United States Patent [19]

Freesh

[11] 4,356,806

[45] Nov. 2, 1982

[54] EXHAUST GAS RECIRCULATION SYSTEM

[76] Inventor: Charles W. Freesh, 2618 E. Elm, Phoenix, Ariz. 85016

[21] Appl. No.: 206,611

[22] Filed: Nov. 13, 1980

[51] Int. Cl.[3] ..... F02M 25/06

[52] U.S. Cl. ..... 123/570

[58] Field of Search ..... 123/570

[56] References Cited

U.S. PATENT DOCUMENTS

| | | | |
|---|---|---|---|
| Re. 22,994 | 4/1948 | Bicknell | 123/570 |
| 1,768,854 | 7/1930 | Moore | 123/570 |
| 2,408,846 | 10/1946 | Golden et al. | 123/570 |
| 2,543,194 | 2/1951 | Paris, Jr. | 123/570 |
| 2,584,674 | 2/1952 | Costa | 123/570 |
| 3,304,711 | 2/1967 | Eastman | 123/570 |
| 3,492,980 | 2/1970 | Beck | 123/570 |
| 3,605,710 | 9/1971 | Helwig | 123/570 |
| 3,648,672 | 3/1972 | Muroki et al. | 123/570 |
| 4,055,158 | 10/1977 | Marsee | 123/570 |
| 4,147,141 | 4/1979 | Nagano | 123/570 |
| 4,323,045 | 4/1982 | Yamashita | 123/570 |

*Primary Examiner*—Wendell E. Burns

*Attorney, Agent, or Firm*—Drummond, Nelson & Nissle

[57] ABSTRACT

An exhaust gas recirculation system for an internal combustion engine. The internal combustion engine including at least one combustion chamber; an intake mechanism for delivering a combustible fluid mixture to the combustion chamber; an ignition system for igniting the combustible mixture; and an exhaust system for carrying exhaust fluid produced by the combustion of the combustible fluid mixture away from the combustion chamber. The exhaust gas recirculation system includes a mechanism for diverting a portion of the exhaust fluid passing through the exhaust system; a conduit attached to the diverting mechanism for carrying the diverted fluid to the intake mechanism of the internal combustion engine; a heat sink connected to the conduit for removing heat from the diverted portion of the exhaust fluid; and a filter integrated along the conduit to remove particulate from the diverted exhaust fluid.

5 Claims, 5 Drawing Figures

F2
FI
V

EXHAUST GAS RECIRCULATION SYSTEM

This invention relates to an exhaust gas recirculation system for an internal combustion engine.

More particularly, the invention concerns a system for recirculating engine exhaust gases in which exhaust gases bled from the exhaust stream of an internal combustion engine are cooled, directed through a filter which evenly disperses water vapor contained in the exhaust gases throughout the gases, and then returned to the internal combustion engine.

In another respect, the invention relates to an exhaust recirculation system which, in diverting a portion of the gases in the exhaust stream flowing from the engine, only causes a minimal increase in the exhaust system back pressure on the internal combustion engine.

In a further respect, the invention pertains to an improved internal combustion engine exhaust gas recirculation system which is of unusually simple construction and manufacture and is readily installed on existing motor vehicles.

In still another aspect the invention concerns an improved internal combustion engine exhaust gas recirculation system which functions both in cool weather and in the unusually warm weather of the Southwestern United States without causing vapor locks or backfiring in the engine.

In yet another respect, the invention relates to an improved exhaust gas recirculation system which substantially reduces the level of carbon monoxide and other pollutants in the exhaust gas of an internal combustion engine.

U.S. Pat. No. 4,114,370 to Woods describes an exhaust gas recirculation system in which an auxiliary pipe section is integrated with the tailpipe of a motor vehicle to divert a portion of the exhaust gases flowing through the tailpipe. The auxiliary pipe section causes the exhaust stream flowing from the engine to undergo two 180° changes in direction before exiting the end of the tailpipe into the atmosphere. Several disadvantages associated with the Woods system severely limit its potential use. First, the auxiliary pipe section is fabricated from pipe having a relatively large inner diameter so that exhaust gases will smoothly pass through the auxiliary pipe section despite the 180° elbows integrated therein. An auxiliary pipe section constructed from such large diameter pipe is bulky and impractical to install, especially on the compact and subcompact cars which comprise such a large proportion of cars presently sold in the United States. Second, regardless of the diameter of pipe utilized, the 180° elbows in the auxiliary pipe section restrict the flow of exhaust gases from the internal combustion engine, resulting in back pressure which increases the operational termperature of and tends to cause surging or backfiring in the engine. Yet another problem inherent in the Woods system is that during operation of the system in warm weather the high temperature of recirculated gas returned to the engine tends to cause vapor locks and the engine dieseling associated therewith.

Accordingly, it would be highly desirable to provide an improved exhaust gas recirculation system which was of compact construction and manufacture and could be readily installed on existing motor vehicles, particularly on compact cars.

It would further be highly desirable to provide an improved exhaust gas recirculation system which would cause a minimal increase in the back pressure on an internal combustion engine and would function at high ambient temperatures without causing dieseling or vapor locks in the engine.

Therefore, it is the principal object of the present invention to provide an improved exhaust gas recirculation system for reducing the noxious emissions from and decreasing the fuel consumption of an internal combustion engine.

Another object of the invention is to provide an improved exhaust gas recirculation system which diverts a portion of the gases in the exhaust stream of an engine, cools the diverted gases, evenly disperses water vapor contained in the gases throughout the gases and then returns the diverted gases to the intake system of the engine.

A further object of the invention is to provide an improved exhaust gas recirculation system which, in diverting a portion of gas from the exhaust stream of an engine, causes only a minimal increase in the back pressure of the internal combustion engine.

Yet another object of the instant invention is to provide an improved exhaust gas recirculation system which can readily be installed on existing motor vehicles and which functions during unusual weather without causing vapor locks or uneven distribution of fuel to the cylinders of an internal combustion engine.

Still a further object of the invention is to provide an improved exhaust gas recirculation system which, after installation and adjustment, does not utilize any moving parts during the operation thereof.

These and other, further and more specific objects and advantages of the invention will be apparent to those skilled in the art from the following detailed description thereof, taken in conjunction with the drawings, in which.

Figures 1, 2, 3, 4, 5:
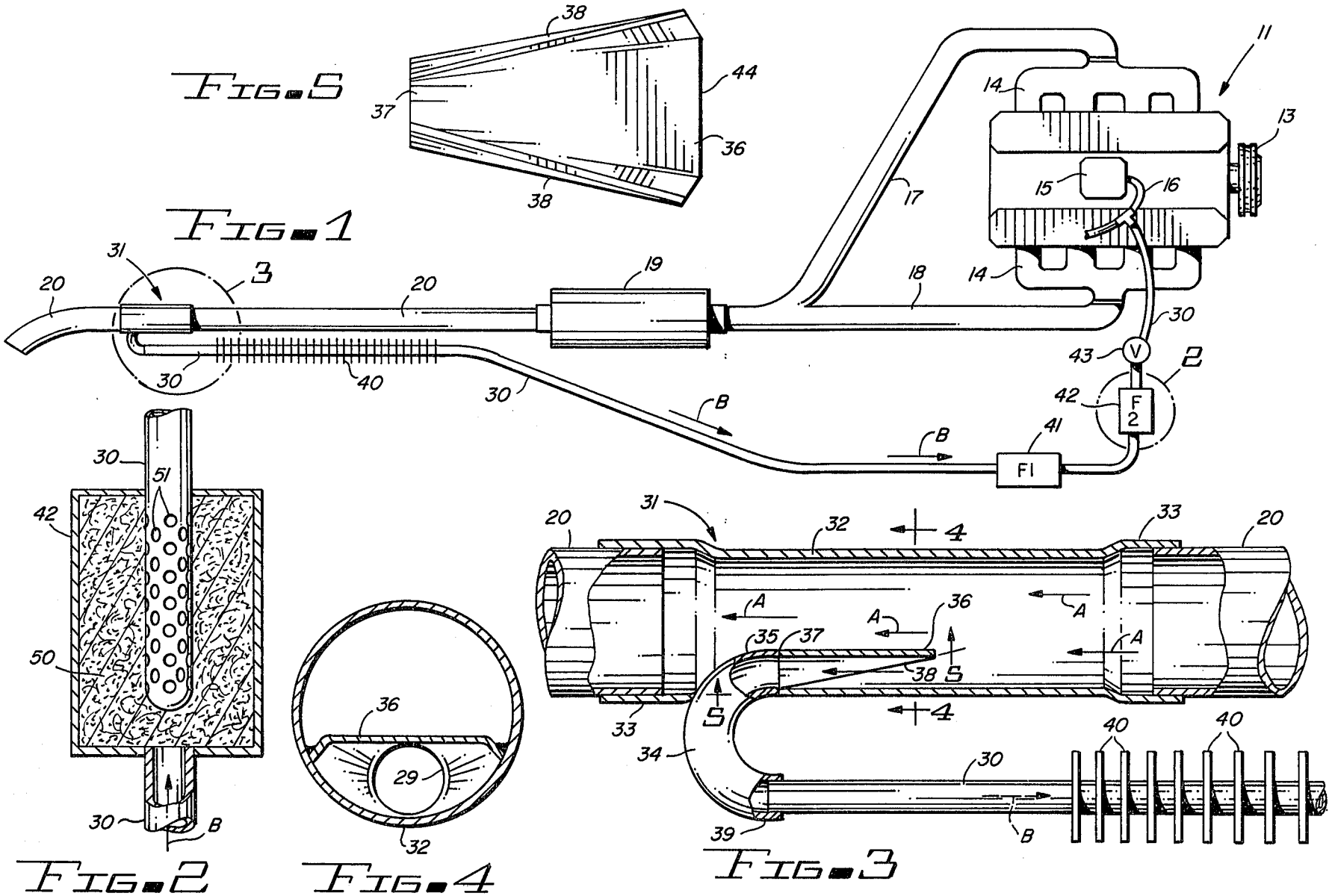
FIG. 1 is a top schematic view of an internal combustion engine provided with the presently preferred embodiment of an exhaust gas recirculation system constructed in accordance with the invention.
FIG. 2 is a sectional view of a filter of the exhaust gas recirculation system of FIG. 1.
FIG. 3 is a partional sectional view of a portion of the exhaust gas recirculation system of FIG. 1 illustrating details of the interior construction thereof.
FIG. 4 is a sectional view of the apparatus of FIG. 3 taken along section line 4—4 thereof.
FIG. 5 is a perspective view of a portion of the apparatus of FIG. 3.

Briefly, in accordance with my invention, I provide an improved exhaust gas recirculation system for an internal combustion engine. The internal combustion engine includes at least one combustion chamber, intake means for delivering a combustible fluid mixture to the combustion chamber, ignition means for igniting the combustible mixture, and exhaust means for carrying exhaust fluid produced by the combustion of the combustible fluid mixture away from the combustion chamber. The improved exhaust gas recirculation system removes a portion of the exhaust fluid passing through the exhaust means and returns the removed portion of fluid to the intake means for delivery to the combustion chamber to improve the combustion of the combustible fluid mixture and to internally clean the engine. The improved system includes bleeding means for diverting a portion of the exhaust fluid passing through the exhaust means; conduit means attached to the bleeding means for carrying the diverted fluid to the intake means of the internal combustion engine; heat sink means connected to the conduit means for removing heat from the diverted portion of the exhaust fluid; and filter means integrated along the conduit means to remove particulate from the diverted exhaust fluid.

Turning now to the drawings, which depict the presently preferred embodiment of the invention for the purpose of illustrating the practice thereof and not by way of limitation of the scope of the invention and in which like reference characters illustrate corresponding elements throughout the several views, FIG. 1 shows a conventional gasoline powered internal combustion engine generally indicated by reference character 11 and provided with an exhaust gas recirculation system constructed in accordance with the invention. Engine 11 includes block 12 housing cylinders and pistons reciprocally received therein, flywheel 13, exhaust manifolds 14 and carburetor 15 receiving line 16 from the PVC valve (not shown) of the engine. Exhaust gases discharged through manifolds 14 travel along conduits 17, 18 through muffler 19 and out tailpipe 20.

As illustrated in FIGS. 1–5 the exhaust gas recirculation system includes conduit 30 which transports exhaust gases removed from tailpipe 20 by the bleeding mechanism 31 to PVC line 16. Bleeding mechanism 31 comprises pipe section 32 having swaged ends 33 which receive the existing tailpipe 20. End 35 of elbow 34 is passed through an aperture formed in the wall of pipe 32 and welded to ventura shield 36 along interface 37 which defines aperture 29. Ventura shield 36 is welded to the inner wall surface of pipe 32 along edges 38. End 39 of elbow 34 is shaped to receive conduit 30. Conduit 30 is provided with cooling fins 40 attached thereto in closely spaced generally parallel relationship, with filters 41, 42 and with ball valve 43. The kinetic energy of the exhaust stream and vacuum "pull" of PVC line 16 cause diverted gases to flow through conduit 30.

In operation sampler 31 diverts approximately 15–20% by volume of the exhaust gases flowing through tailpipe 20. Ventura shield 36 is constructed of a thin sheet of somewhat pliable metal so that shield 36 may be slightly upwardly or downwardly bent along edge 44 to control the volume of exhaust gases flowing through tailpipe 20 in the direction indicated by arrows A in FIG. 3. Exhaust gases diverted by sampler 31 flow along conduit 30 in the direction indicated by arrows B. Cooling fins 40, conduit 30, filters 41, 42 and valve 43 carry heat away from and cool the diverted exhaust gases to at least 140° F. When the temperature of recirculated gases entering engine 11 through conduit 16 is above 140° F., there is a greater likelihood that vapor locks and engine surging will occur. Engine surging normally occurs when the temperature of the recirculated gases exceeds 140° F. because hot gases contacting the fuel-air mixture in carburetor 15 cause the fuel in the mixture to expand, resulting in uneven fuel distribution between the cylinders.

After passing through the section of conduit 30 provided with fins 40, the diverted exhaust gases enter filters 41, 42 and valve 43. Filters 41, 42 are particularly important when the exhaust gas recirculation system of the invention is initially installed on an older automobile because the recirculation system removes carbon deposits which have built up on the interior of the engine. Thus, after installation of the exhaust gas recirculation system on such an automobile, the exhaust stream carried by conduit 20 will normally contain fairly large particles of carboneous material. Filters 41, 42 prevent this material from being injected into carburetor 15.

As illustrated in FIG. 2, filter 42 includes porous filter material 50. Exhaust gases flowing into filter 42 often contain water droplets which could, if fed directly into carburetor 15, cause the engine to hesitate or surge. When exhaust gases entering filter 42 are forced to flow through material 50 and into perforations 51 of conduit 30, water droplets are broken up and the water more evenly distributed throughout the exhaust gases.

Exhaust gases exiting filter 42 pass through an opening in valve 43. At present, when the exhaust gas recirculation system is installed on a V-8 engine the valve is opened an amount which creates a vacuum of approximately five to six inches of mercury in conduit 30 leading to valve 43 when the engine is idling at about 700 rpm. When the valve is adjusted to this setting, the vacuum in conduit 30 leading to valve 43 from filter 42 stays fairly constant through an engine operational speed of 2500 rpm.

Cooled exhaust gases passing through valve 43 are introduced into PCV line 16 which carries the exhaust gases into the base of carburetor 15. PCV line 16, carburetor 15, the fuel supply (not shown), fuel lines (not shown), passage means for carrying fluids to and from the combustion chamber (not shown) and the air filter (not shown) all constitute part of the intake means of engine 11. The recirculated exhaust gases are injected into carburetor 15 below or at the level of the carburetor screens which atomize the fuel-air mixture. Injecting the recirculated exhaust gases into the fuel before it is passed through the screens causes the fuel contacted by the hot recirculated gases to expand, resulting in uneven fuel distribution between the cylinders of the engine.

When the exhaust gas recirculating apparatus of the invention is installed on a conventional gasoline powered internal combustion engine a 15–30% increase in gasoline mileage is realized under normal ambient air conditions. During low humidity conditions a 10–15% mileage increase is typically realized. In addition to the increased gasoline mileage, the amount of carbon monoxide contained in the exhaust gases flowing from the engine decreases to 2.0% or less, by volume thereof.

As would be appreciated by those of skill in the art, the exhaust recirculation apparatus of the invention could be utilized on a variety of internal combustion engines and the recirculated gases could be directed into the intake means of an internal combustion engine at numerous points. For instance, in a diesel engine the recirculated exhaust gases would preferably be introduced into the air inlet passages leading to the combustion chambers of the engine. The majority of internal combustion engines in widespread use today basically cause only two fluids to flow into the combustion chambers thereof, air and a combustible liquid fuel.

Having described my invention in such terms as to enable those skilled in the art to understand and practice it and having identified the presently preferred embodiment thereof, I claim:

1. In combination with an internal combustion engine, said engine including, at least one combustion chamber, intake means for delivering a combustible fluid mixture to said combustion chamber, ignition means for igniting said combustible mixture, and exhaust means for carrying exhaust gas produced by the combustion of said combustible fluid mixture away from said combustion chamber, said exhaust means including a tail pipe, air cooled means for removing a minor effective portion of said exhaust gas passing through said tail pipe in a normal direction of travel, cooling said minor portion of said gas by conducting heat from the gas with air cooled solid materials and by expanding the gas, and returning said cooled minor portion of said exhaust gas to said intake means for delivery to said combustion chamber to improve the combustion of said combustible fluid mixture and to internally clean said engine, said air cooled means comprising, (a) channel means integrated with said tail pipe and having an opening for receiving and diverting from said tail pipe a minor effective portion of said gas passing through said tail pipe, said opening and said channel means being positioned with respect to said tail pipe such that gas flows into said opening and said channel means while said gas continues to move in said normal direction of travel;

(b) a single substantially continuous heat conductive conduit in fluid communication with and connected at one end to said channel means, and integrated at the other end and in fluid communication with said intake means such that a vacuum is formed in said other end of said conduit, said conduit having an exterior surface and including (i) a plurality of spaced heat conductive cooling fins mounted on and extending outwardly from at least a portion of said exterior surface of said conduit, said fins drawing heat from said conduit and said gas passing therethrough and transferring said heat to air contacting said fins, (ii) a filter integrated with said conduit and comprised of a porous material, said gas diverted from said tail pipe by said channel means moving along said conduit and passing into and through said filter and back into said conduit, said filter removing particulate from said gas passing therethrough and breaking up condensed water droplets carried in said gas, (iii) a valve integrated in said conduit, said valve being adjusted so that the vacuum in said conduit leading to said valve is less than the vacuum in said conduit leading from said valve to said intake means so that fluid traveling through said conduit expands and cools on passing through said valve into said conduit leading from said valve to said intake means.

2. The apparatus of claim 1 wherein said gas passing through said conduit is cooled to a temperature of less than 140° F.

3. The apparatus of claim 1 wherein said channel means diverts 15 to 20% of the fluid passing through said tail pipe into said conduit.

4. The apparatus of claim 3 wherein said opening of said channel means is positioned in the cylindrical elongate space comprising the interior of said tail pipe and has an area occupying a minor portion of the cross sectional area of said cylindrical interior space of said tail pipe.

5. The apparatus of claim 4 wherein the area of said opening of said channel means is less than the cross sectional area of said conduit so that the velocity of said gas increases as said gas flows through said opening and said channel means and into said conduit.

* * * * *